United States Patent [19]

Pappanikolaou

[11] 4,061,004

[45] Dec. 6, 1977

[54] PICK-PROOF LOCK CYLINDER AND KEY THEREFOR

[76] Inventor: George Pappanikolaou, 621 90th St., Brooklyn, N.Y. 11228

[21] Appl. No.: 740,212

[22] Filed: Dec. 1, 1976

[51] Int. Cl.[2] ..... E05B 19/12; E05B 27/03

[52] U.S. Cl. ..... 70/363; 70/27 C; 70/399; 70/DIG. 49

[58] Field of Search ..... 70/276, 362, 363, 364 R, 70/364 F, 393, 395, 396, 397, 398, 399, DIG. 49

[56] References Cited

U.S. PATENT DOCUMENTS

| | | | |
|---|---|---|---|
| 1,369,449 | 2/1921 | Maksym | 70/399 |
| 1,438,525 | 12/1922 | Godlewski | 70/399 |
| 1,567,979 | 12/1925 | Northrop | 70/399 |
| 2,296,029 | 9/1942 | Hagstrom | 70/399 |

*Primary Examiner*—Robert L. Wolfe
*Attorney, Agent, or Firm*—Lackenbach, Lilling & Siegel

[57] ABSTRACT

A pick-proof lock cylinder and key therefor are described. The lock cylinder has a keyhole which opens to provide access to the cylinder, and two cam surfaces are provided at the remote end of the keyhole configurated to deflect a pair of coded, pivotally mounted fingers on a jointed key which is receivable within the keyhole. The revolving cylinder or tumbler includes a plurality of enabling pins or plungers which are generally spaced from each other along a direction substantially normal to the length direction of the keyhole. The fingers of the key may be mechanically or magnetically coded to cause the enabling pins or plungers to be actuated when the key is fully inserted into the keyhole and the coded fingers are deflected to their operative positions by the cam surfaces. Additionally, sensing or monitoring pins enable the proper actuation of the enabling pins or plungers only upon detection of a suitably coded key. Additional pick-proof pins are provided for preventing picking of the lock by indiscriminate actuation of all of the enabling pins or plungers. Provision is also made for alarm means which includes one or more switches arranged to sense the relative positions of the tumbler, the sensing or monitoring pins, as well as a plurality of additional sensing or alarm disabling rods whch are mounted for detecting a preselected code placed on the shank of the key.

30 Claims, 44 Drawing Figures

FIG. 7
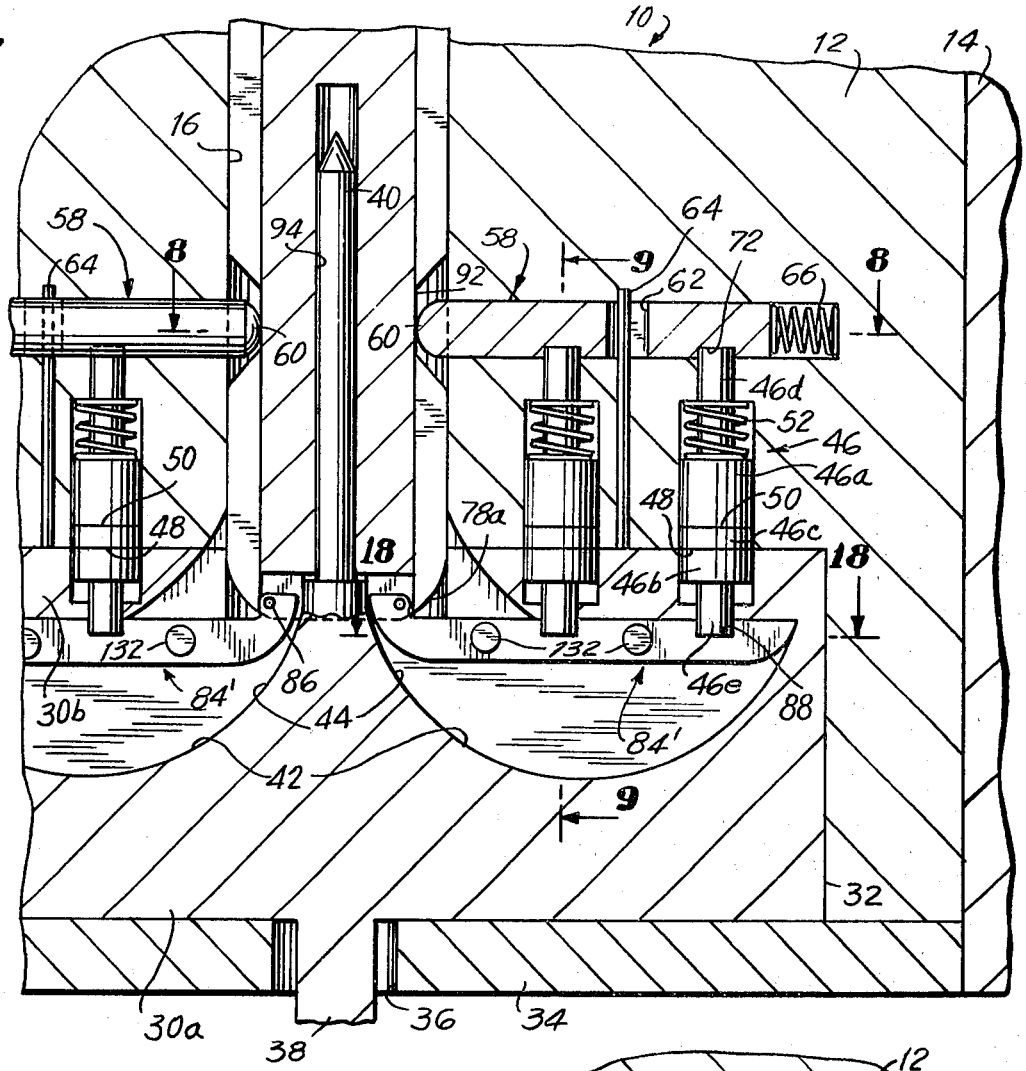
FIG. 8
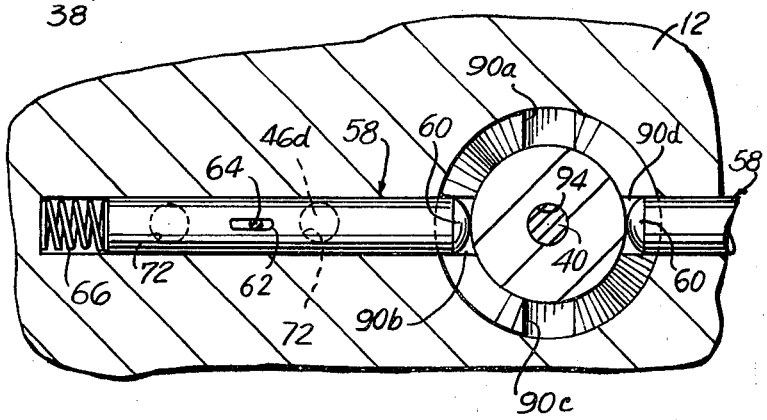
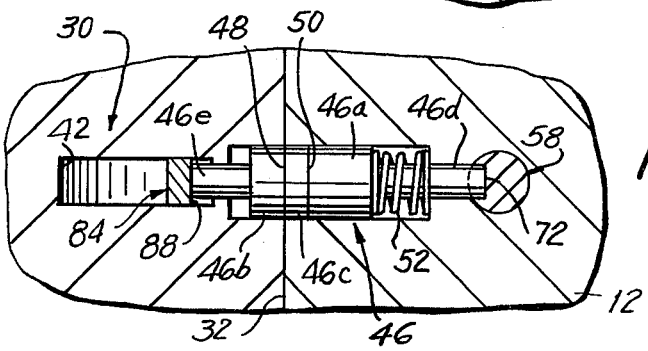
FIG. 9

122
122a
122b
SW1
SW2
SW3
SW4
SW5
SW6
SWx
SWy
"A"
"B"
"C"

122
122a
SW1
SW2
SW3
SW4
SW5
SW-X
SW-Y
"A"
"B"
"C"

10'
12
30
32
42
84'
132
132a
134a
134b
135
136
138
140
142
144
146a
146b
148
150
152a
152b
154
N
S
(N)
(S)
N OR S

PICK-PROOF LOCK CYLINDER AND KEY THEREFOR

BACKGROUND OF THE INVENTION

This invention generally relates to locking mechanisms, and more specifically to a pick-proof lock cylinder and key therefor.

Most lock mechanisms in use include a housing having a generally cylindrical bore therethrough in which is mounted a revolving cylinder or tumbler. A plurality of biased pins or plungers are provided which cooperate with the housing and the revolving cylinder to enable or inhibit the rotation of the tumbler, the plungers or pins being arranged to detect a suitably coded key which actuates one or more of these plungers or pins. With most commonly used constructions, the revolving cylinder or tumbler is mounted in a through bore of the housing, and the keyhole which accepts the key extends substantially through the revolving cylinder. The pins or plungers are typically arranged along the axis of the tumbler and engage the key as the same is moved into the keyhole.

A problem which exists with most lock cylinders in use today is that the above-described constructions make it possible for the locks to be violated by picking or partially destroying the same. Picking of such locks has been facilitated by the fact that the plungers or pins are arranged in line with the keyhole and, therefore, are readily accessible to one who is skilled in picking such locks, Other locks have the decoding pins or plungers situated proximate to the keyhole or to the keyhole opening so that their operation may be destroyed by drilling into one or another portion of the revolving cylinders. Most typically, revolving cylinders of this type may be made inoperative by simply drilling a hole along the axis of the keyhole and thereby destroying the decoding means or the pins and plungers which are arranged to sense the key.

As suggested above, most revolving cylinders of commonly used locks extend substantially the entire length of the housing and, therefore, are exposed and accessible at the opening of the keyhole. This permits tampering with the revolving cylinder and the picking thereof.

Various attempts have been made to overcome the above-mentioned problems and to minimize the risk of having a lock picked. Some early attempts at overcoming the problem are exemplified in U.S. Pat. Nos. 866,697 and 888,478. In the first mentioned patent, a key was used which had a bifurcated resilient member at one end thereof which was adapted to engage a suitable actuating mechanism within the lock. The portions making up the bifurcated end of the key were slightly spaced from the axis of the key. However, this lock did not utilize a cylinder of the type commonly used today and did not use pins or plungers. Instead, the lock of this reference utilized a sliding latch arrangement which would not provide much pick-proof protection. The bifurcated end of the key was initially compressed by a channel of reduced diameter which was in turn provided with a pair of slots internally of the lock which permitted the bifurcated end to expand when brought into registry with the slots. At such time, the bifurcated end could engage and actuate the latch mechanism. The second patent was also for a lock but utilized a key which was in actuality a double key, one portion having a straight shank and the other portion having a curved shank, with both portions being pivotally connected to each other. Before the latch mechanism of this lock could be actuated, it was necessary to insert the key in such a manner so that both straight and curved shank portions engaged respective or cooperating elements within the lock.

Further attempts have been made to produce a pick-proof lock. These have included locks which use a key having a pivoted free end which is adapted to turn or rotate a predetermined angular distance upon full insertion of the key into the lock to engage an element which would not otherwise be engageable by a straight shank. For example, in U.S. Pat. No. 1,596,336, a lock is disclosed which uses a key having a pivoted end member which is initially aligned with the shank of the key in one position thereof. However, when the key is turned approximately 180°, the pivoted end portion moves, due to gravity, to a position which permits the same to engage a latch. Further rotation of the key causes the latch to move. In order to provide somewhat more control over the action of the key, and more particularly over the pivoted free end thereof, further constructions have been proposed wherein the position of the pivotally mounted free end may be controlled at the exposed end of the key or in the region of the gripping portion thereof. Such constructions are disclosed in U.S. Pat. Nos. 1,464,194 and 1,750,542. In all of these patents, however, the movement of the pivoted end towards the final or operative position only causes the pivoted portion to engage a latch or the like and could not, in and of itself, be utilized with the more modern and more complex locks which are in use today.

Other locks which are known in the prior art include a key which has a pivotally mounted finger thereon, the finger itself being provided with a cam surface which engages an abutment upon insertion of the key into the cylinder to cause the finger to be deflected from its initial axially aligned position to one where the fingers may be approximately 90° displaced from that initial position. In U.S. Pat. Nos. 1,274,313 and 2,296,029, these pivotally mounted fingers engage a latch mechanism in the pivoted or actuating position, while in U.S. Pat. No. 1,567,979, the finger engages a pair of spring loaded pins or plungers. However, the last described construction has the disadvantages above described since it includes a revolving cylinder exposed to the outside and, therefore accessible for tampering therewith. Additionally, the spring loaded pins or plungers are mounted substantially in line with the keyhole and, therefore, this invites for the lock to be violated by simply drilling through the keyhole.

As an examination of the abovementioned patents will reveal, most prior art key constructions which have utilized pivotally mounted end portions are generally for large and bulky locks and are impractical for most common consumer uses.

SUMMARY OF THE INVENTION

Accordingly, it is a primary object of the present invention to provide a lock cylinder which overcomes the above-described disadvantages associated with the prior art locks.

It is another object of the present invention to provide a lock which is pick-proof.

It is still another object of the present invention to provide a lock cylinder which is physically stronger than prior art comparable lock cylinders and which may not be easily tampered with, destroyed or otherwise disabled or picked.

It is yet another object of the present invention to provide a pick-proof lock cylinder and key therefor which may utilize conventional spring-loaded pins or plungers as decoding means, as well as force field producing materials for decoding including magnets and electrets.

It is a further object of the present invention to provide a pick-proof lock which utilizes a jointed key which can be reproduced on conventional key-cutting apparatus.

It is still a further object of the present invention to provide a lock cylinder which discourages tampering therewith by providing means connectable to an alarm system for initiating an alarm upon attempts at picking the lock.

It is yet a further object of the present invention to provide a lock cylinder which utilizes a key provided both with coded fingers as well as coded shank, and which includes enabling means for enabling the operation of the lock not only when the fingers are properly coded but also when the shank is properly coded.

It is an additional object of the present invention to provide a lock cylinder which is adapted to be used with a jointed key having pivotally mounted fingers which can be coded with a very large number of combinations without physically modifying the fingers.

It is yet an additional object of the present invention to provide means in the nature of pick-proof redundant decoding means which disables the operation of the lock cylinder when actuated improperly simultaneously with the actuation of the basic decoding means.

It is a further additional object of the present invention to provide a lock cylinder wherein the decoding means or decoding pins or plungers can be increased to provide maximum security.

Another additional object of the invention is to provide a lock cylinder and jointed key for use therewith which are initially coded and which can have the code changed to permit changes in combinations to which the lock cylinder will respond.

In order to achieve the above objects, as well as others which will become apparent hereafter, a lock cylinder in accordance with the present invention is adapted for use with a jointed key which generally defines an axis and has at least one pivotally mounted coded finger which is movable between an initial position substantially parallel to the axis and a final position substantially normal to the axis. The lock cylinder comprises an external housing having two coaxial cylindrical cavities in communication with each other. One of the cylindrical cavities defines a keyhole for the jointed key and has an opening to the exterior of the external housing at one end and a remote end proximate to the other of the two cavities. The keyhole has a diameter generally smaller than that of the other cavity. A revolving cylinder is provided and disposed beyond the remote end of the keyhole and has a diameter generally corresponding to that of the other cavity and mounted only for free coaxial rotation therein. An actuating arm is provided mounted on the revolving cylinder for common rotation therewith and adapted to cooperate with an associated lock mechanism. The revolving cylinder is provided with at least one cam surface generally facing the one cavity and has a surface portion proximate thereto wherein insertion of the jointed key into the lock cylinder causes the finger to initially abut against the cam surface portion. The cam surface is configurated to move the finger from the initial position to the final position upon full insertion of the jointed key into the lock cylinder. Decoding means is provided spaced from the axis of the cavities and cooperates with the external housing and the revolving cylinder for normally preventing the revolving cylinder from rotating relative to the external housing and permitting the same to rotate only when the decoding means detects an appropriate code on the finger in the final position of the finger.

In the presently preferred embodiment, the cam surface is generally continuously curved and in the form of a circular cylindrical surface. Alarm actuating means are advantageously provided for actuating an alarm whenever any element within the lock is improperly actuated by anything but a properly coded key.

BRIEF DESCRIPTION OF THE DRAWINGS

Further advantages of the invention will become apparent from a reading of the following specification describing illustrative embodiments of the invention. This specification is to be taken with the accompanying drawings in which:

FIG. 7 is similar to FIGS. 1 and 6, and showing the key in its fully inserted position with the coded fingers in their operative positions to actuate the decoding plungers or pins, and further showing the coded fingers provided with magnets spaced along their lengths as alternate or additional coding means also shown in FIG. 18;

FIG. 8 is a fragmented cross-sectional view taken along line 8—8 in FIG. 7, and is similar to FIG. 4 except that a key is shown inserted into the keyhole to activate the enabling biased pins;

FIG. 9 is a fragmented cross-sectional view taken along line 9—9 in FIG. 7 and is similar to FIG. 5 except that a coded finger is shown in abutment against a decoding pin or plunger to move the same a predetermined distance to a position which unlocks the revolving cylinder from the external housing;

DESCRIPTION OF THE PREFERRED EMBODIMENTS

Figures 1, 2, 3, 11, 17:
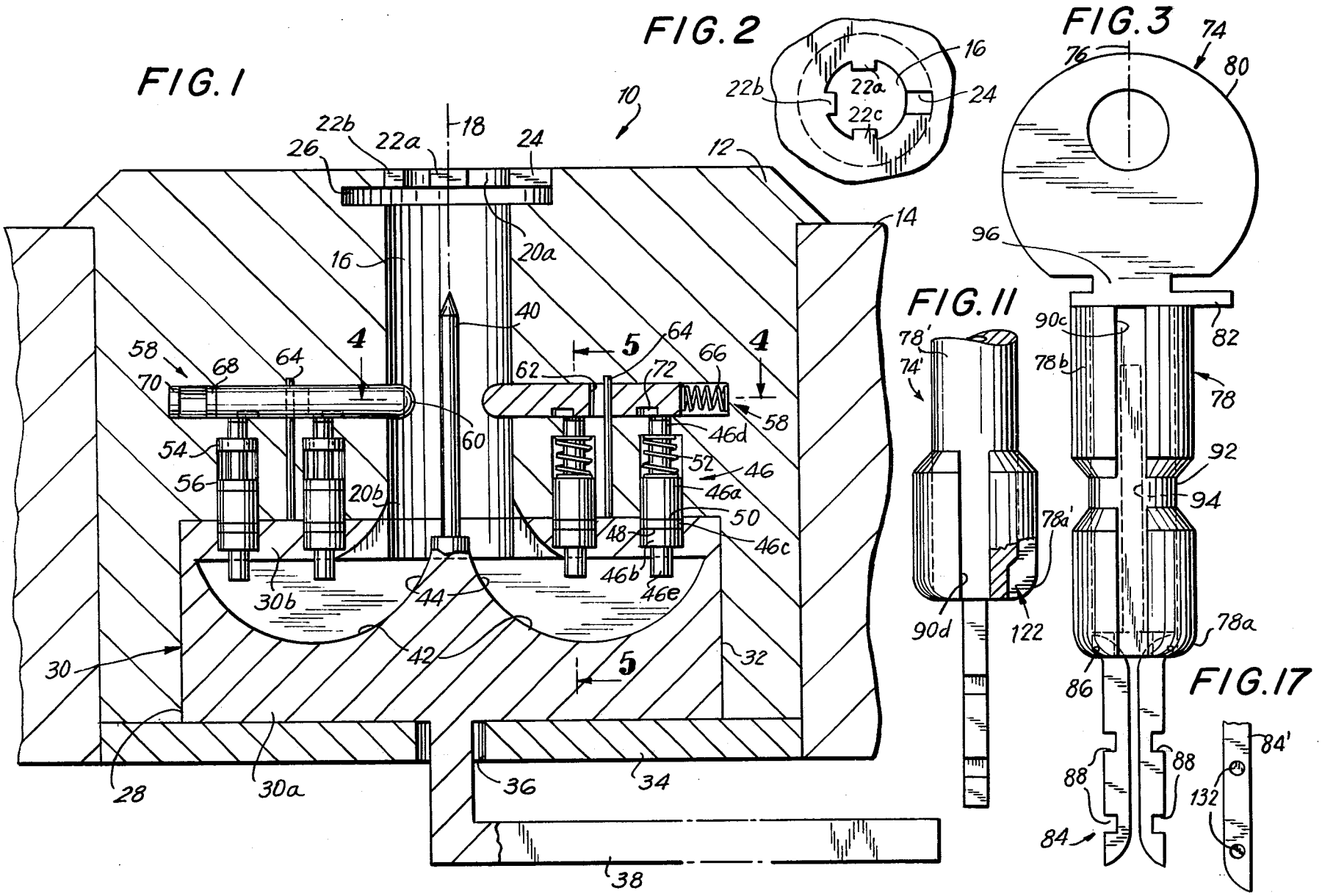
FIG. 1 is a longitudinal cross-sectional view of the lock cylinder in accordance with the present invention.
FIG. 2 is a fragmented top plan view of the external housing of the lock cylinder shown in FIG. 1, to show the keyhole opening and the alignment means for aligning the key within the keyhole.
FIG. 3 is a side elevational view of a jointed key in accordance with the present invention for use with the lock cylinder shown in FIG. 1.
FIG. 11 is a fragmented side elevational view of a modified jointed key, showing the manner in which the shank of such a key is coded for use with the modified lock cylinder shown in FIG. 10 which incorporates alarm sensing rods as shown in FIG. 12.
FIG. 17 is an enlarged fragmented free end portion of a coded finger of a jointed key in accordance with the present invention, similar to the finger shown in FIG. 7, for use with field force responsive decoding means of the type shown in FIGS. 18–25.
Figure 4:
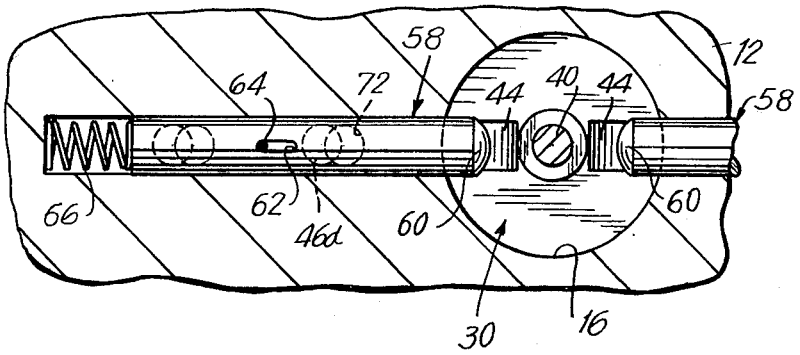
FIG. 4 is a fragmented cross-sectional view taken along line 4—4 in FIG. 1, and showing the initial position of the biased pins which enable the actuation of the decoding plungers or pins upon actuation by an appropriately coded key.
Figure 5:
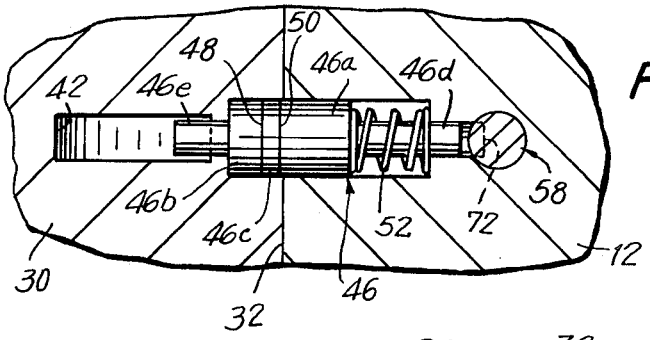
FIG. 5 is a fragmented cross-sectional view taken along line 5—5 in FIG. 1, and showing the initial position of a decoding plunger or pin in its initial or locking position.
Figure 6:
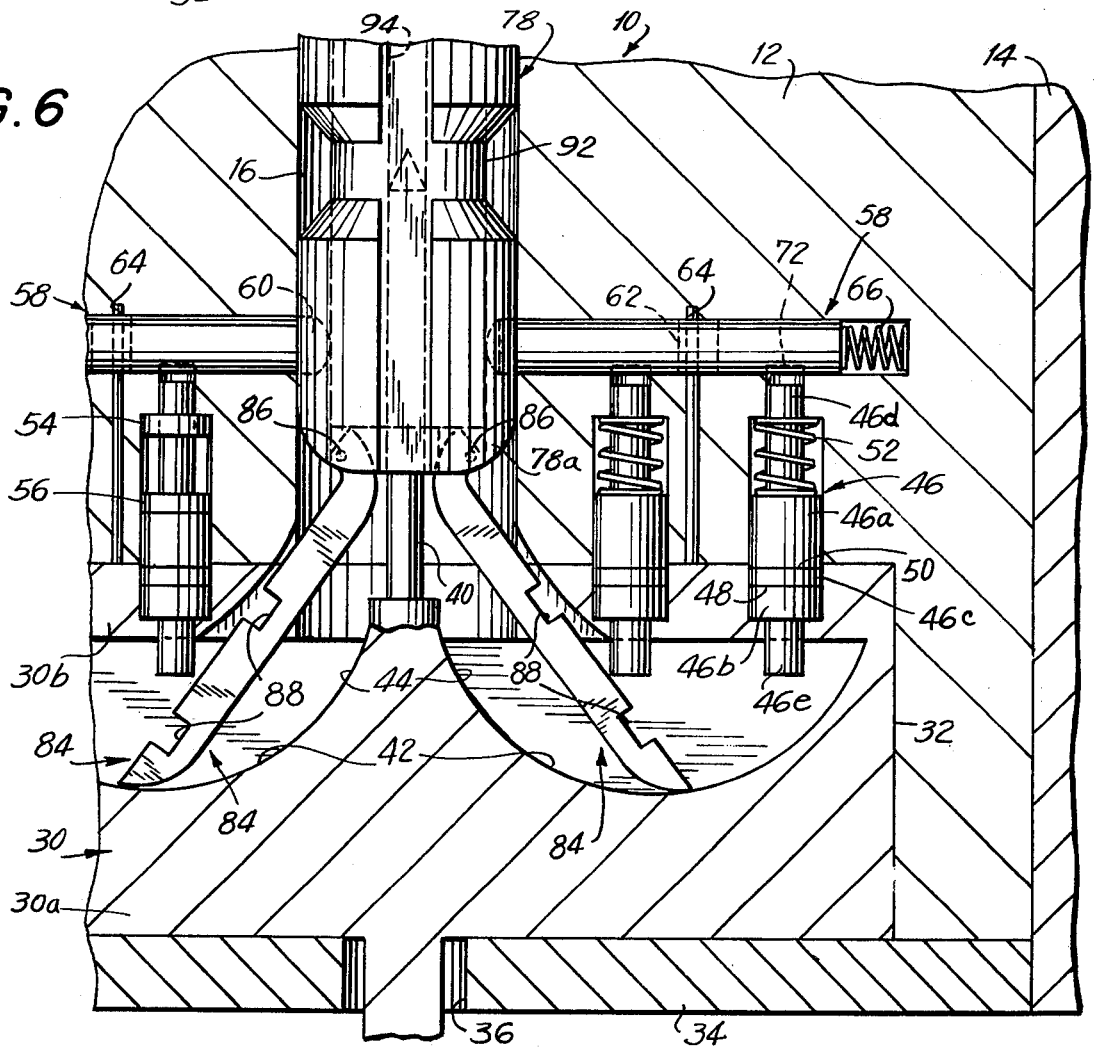
FIG. 6 is similar to FIG. 1, showing the jointed key partially inserted into the keyhole and the coded fingers riding upon the cam surfaces within the revolving cylinder.

Referring now specifically to the drawings, in which identical or similar parts are designated by the same reference numerals throughout, the first referring to FIG 1, there is shown a lock cylinder in accordance with the present invention which is generally designated by the reference numeral 10.

The lock cyclinder 10 has an external housing 12 which is mounted on a lock mechanism 14 in any conventional manner.

The external housing 12 has a first cylindrical cavity which defines a keyhole 16 which is generally elongate and has an axis 18. The keyhole 16 has an externally accessible opening 20*a* and a remote end 20*b* which is spaced from the opening 20*a* and recessed within the external housing 12.

Referring to FIGS. 1 and 2, the opening 20*a* is shown to be formed with a plurality of alignment tabs 22*a*–22*c* which project inwardly of the opening 20*a* for reasons which will be described hereafter. Additionally, an alignment opening 24 is provided which communicates with an annular channel 26 which will also be more fully described below.

The external housing 12 is formed with a second cavity which is defined by the inner cylindrical wall 28 which is coaxial with the axis 18. The cavities 16 and 28 are each advantageously cylindrical and coaxial with each other, with the cavity 16 having a smaller diameter than that of the cavity 28.

A revolving cylinder 30 is provided which is disposed beyond the remote end 20*b* of the keyhold 16, the revolving cylinder having a diameter generally corresponding to that of the cavity 28 and mounted for free rotation about the axis 18. The revolving cyclinder 30 has a rearwardly disposed revolving cylinder portion 30*a* and a forwardly disposed revolving cylindrical portion 30*b* proximate to the keyhole 16. the revolving cylinder 30 has an exterior surface which generally mates with the internal surface of the cylindrical cavity 28 formed by the external housing 12, with these mating surfaces together defining a first junction plane 32. The junction, it is to be noted, extends about the entire external surface of the revolving cylinder 30, including the circumferential curved surfaces as well as the flat circular surfaces at the axial ends of the revolving cylinder.

Although it is not a critical freature of the present invention as to the precise manner in which the revolving cylinder 30 is enclosed within the cylindrical cavity 28, a closure plate 34 is shown, by way of example only, as one means for enclosing the revolving cylinder 30 within the cavity 28. When a closure place 34 is utilized, it is provided with a generally coaxial opening 36 through which an actuating arm 38 is connected to the revolving cylinder to share the common rotational movements thereof. The actuating arm 38 may be connected to any appropriate and conventional lock mechanism.

Extending from the revolving cylinder 30 is a coaxially mounted guide pin 40 which extends through the keyhole 16 for guiding a key as will be described hereafter.

The revolving cylinder 30 is provided with at least one, but preferably two cam surfaces 42 facing the keyhole cavity 16 and which have surface portions 44 proximate to the remote end 20b of the keyhole. In the presently preferred embodiment, the cam surfaces 42 are continuously curved and circular as shown. However, as will be evident to those skilled in the art, any suitable configuration of the cam surfaces 42 may be used which will cause the coded fingers of the jointed key to be deflected a predetermined amount. Thus, for example, the cam surfaces 42 may also be elliptically and hyperbolically shaped.

Decoding means are provided and generally designated by the reference numeral 46 and comprise contact-actuated enabling plungers or pins which are spaced from the axis 18 and cooperate with the external housing 12 and the revolving cylinder 30 for normally preventing the revolving cylinder 30 from rotating relative to the external housing 12 and permitting the same to rotate only when the pins or plungers 46 detect an appropriate code on a suitably coded key.

The plungers or pins 46 comprise at least two axially aligned portions 46a and 46b which together define a second junction plane 48. With such arrangement, the first and second junction planes 32 and 48 respectively, are normally out of alignment and are placed into alignment only when the plungers 46 respond to an appropriately coded key.

The decoding pins or plungers 46 may be divided into three axially aligned portions to define a further or third plunger portion 46c, which further defines a third junction plane 50 which is brought into alignment with the first junction plane 32 only when the plunger 46 is actuated by a suitably coded master key. It may be noted in this connection that appropriate coding involves making contact with a respective plunger or pin 46 and moving the same axially a predetermined distance. Mere actuation is not sufficient. The distances moved are critical inasmuch as the parting planes 48, 50 between various plunger portions 46a, 46b and 46c must become aligned with the first junction plane 32 in order to permit rotation of the revolving cylinder 30 without interference by the plunger portions. Similarly, a master key is defined as a key which actuates and moves all of the plungers or pins, within a lock cylinder 10 of the type under discussion, a preselected distance to bring the third junction planes 50 of all of the plungers 46 simultaneously into alignment with the first junction plane 32.

The two plungers 46 shown to the right of the guide pin 40 in FIG. 1 are shown to be spring loaded by springs 52 which maintain the plungers 46 in the normally locking positions. The two plungers 46 shown on the left of the guide pin 40 in FIG. 1 utilize a ring magnet 54 fixedly mounted on the external housing 12 and a magnet 56 mounted on the plunger 46, the magnets 54 and 56 having the proximate portions thereof like polarity to thereby repel each other and bias the plungers 46.

Still referring to FIG. 1, there is shown enabling means in the nature of a biased pin 58 generally radially oriented with respect to the keyhole 16. The enabling means 58 is slidably mounted on the external housing 12 and has at least a portion thereof 60 projecting into the keyhole 16 for detecting predetermined cross-sectional shank dimensions of an appropriate key inserted therein, the biased pin 58 serving the function of enabling the plungers 46 to move to the aligned conditions of the junction planes 32 and 48 only upon detection of a key having the correct predetermined shank cross-sectional dimensions.

As will be noted, the biased pins 58 have at least one recess 72 therein dimensioned to freely receive a corresponding or associated plunger free end portion 46d when an appropriately coded shank and finger respectively actuate the biased pin 58 and the plunger 46 to bring the recess 72 and the plunger free end 46d into alignment.

When more than one plunger 46 are provided as shown in FIG. 1, the pins 46 are advantageously aligned along a radial direction substantially parallel to the bised pin 58, the biased pin being provided with a plurality of recesses 72 spaced from each other to correspond with the spacing of adjacent pins or plungers 46, whereby appropriate movement of the biased pin 58 brings all of the corresponding recesses 72 into alignment with their cooperating or associated plunger free end portions 46d. It may be noted in this connection that the recesses 72 may have any desired depth, this not being a critical dimension as long as the free end portion 46d can be received therein sufficiently to bring the lowermost or second junction plane 48 into alignment with the first junction plane 32. Therefore, the recess 72 can have a depth greater than that minimum required depth and the free end portions 46d need not be received fully therein.

The enabling pins 58 are mounted for slidable movement as shown in FIG. 1. In order to limit the radial movements of these pins, there may be provided a limiting pin 64 which projects through a radially directed slot 62 within the enabling pins 58, the limits of movement being determined by the length of the slot 62. The arrangement as shown consisting of the slot 62 and limiting pin 64 serves the additional function of preventing rotation of the enabling pins 58 about their own axes and therefore assure that the recesses 72 are always facing the direction of the decoding pins or plungers 46 and are therefore always in a condition to receive the same upon proper actuation by a coded key.

The enabling pins 58 are normally urged or biased to move towards the keyhole 16 or gudie pin 40 by any suitable biasing means. by way of example only, the eanbling pin 58 shown on the right side of the guide pin 40 in FIG. 1 is shown to be spring biased by a spring 66. On the other hand, biasing may be achieved by the use of magnets 68 and 70 respectively mounted on the enabling pin 58 and fixedly mounted on the external housing 12 as shown when the magnets 68 and 70 have the proximate portions thereof the same polarity.

Referring to FIG. 3, there is shown a jointed key 74 of the type which is suitable for use with the lock cylinder 10 shown in FIG. 1. The key 74 has an axis of rotation 76 and a generally elongate cylindrical shank 78 having a leading axial end 78a and a trailing axial end 78b. Provided at the trailing axial end 78b is a gripping portion 80 which may be of any conventional shape or configuration. Adjoining the gripping portion 80 at the trailing axial end 78b is an alignment projection 82 which is dimensioned to be received within the alignment opening 24 of the keyhole 16. Additionally, the thickness of the alignment projection 82 such as to be receivable within the annular channel 26 to thereby permit the alignment projection 82 to move within the annular channel 26 during a revolution of the key 74. Aside from serving as one means for aligning the key 74 during initial insertion into the keyhole, the alignment projection 82 ensures that the key can only be removed in the right or preselected angular position thereof, namely when the alignment projection 82 is aligned with the opening 24. In all other instances, the alignment projection 82 will be positined within the annular channel 26 and the key will not be able to be removed.

As is best shown in FIG. 3, a pair of coded fingers 84 are provided at the leading axial end 78*a* of the shank 78 and are pivotally mounted thereon by means of pivot pins 86. The coded fingers 84 are shown to be provided with a plurality of coding recesses 88 which form abutment surface portions which can be reproduced in conventional key-cutting apparatus. However, as will become evident from the discussion that follows, the fingers 84 can be coded many other ways, including magnetic coding, as suggested in FIG. 17, or by any other conventionally known coding means. The coded fingers 84 are shown in FIG. 3 to be disposed in positions substantially parallel to the axis 76 of the key. However, the coded fingers 84 are movable about pivot pins 86 to positions substantially normal to axis 76, as illustrated in FIG. 7.

The above-described alignment tabs 22*a*–22*c* are dimensioned to cooperate with a plurality of corresponding axial alignment grooves 90*a*–90*d*, as shown in FIG. 8. These axial alignment grooves may extend the entire axial length of the shank 78 as shown in FIG. 3 and are intended to prevent rotation of the key 74 during insertion or removal of the key into the keyhole 16, and only permit rotation thereof once the key has reached its final or fully inserted position. The alignment tabs 22*a*–22*c*, the alignment opening 24, the axial aligning grooves 90*a*–90*d* and the guide pin 40 together form alignment means for guiding and aligning the jointed key within the keyhole. The shank 78 is additionally provided with at least one circumferential groove 92 which has a predetermined cross-sectional dimension. The diameter of the shank 78 at the circumferential groove 92 is selected to actuate the enabling biased in 58 the appropriate distance so as to align the recesses 72 with the cooperating free end portions 46*d* of the plungers. Clearly, the circumferential groove 92 diameter must be accurately determined since escessive or too little movement of the enabling biasing pin 58 will prevent the plungers 46 from assuming their releasing positions. An axial guide pin hole 94 may be provided within the shank 78 when a guide pin 40 is utilized to center the key 74 and maintain the same in its central position during operation thereof. The neck portion 96 is dimensioned to clear the alignment tabs 22*a*–22*c* when the key 74 is inserted into the keyhole 16, so that the key may be rotated without interference from the alignment tabs.

Figure 10:
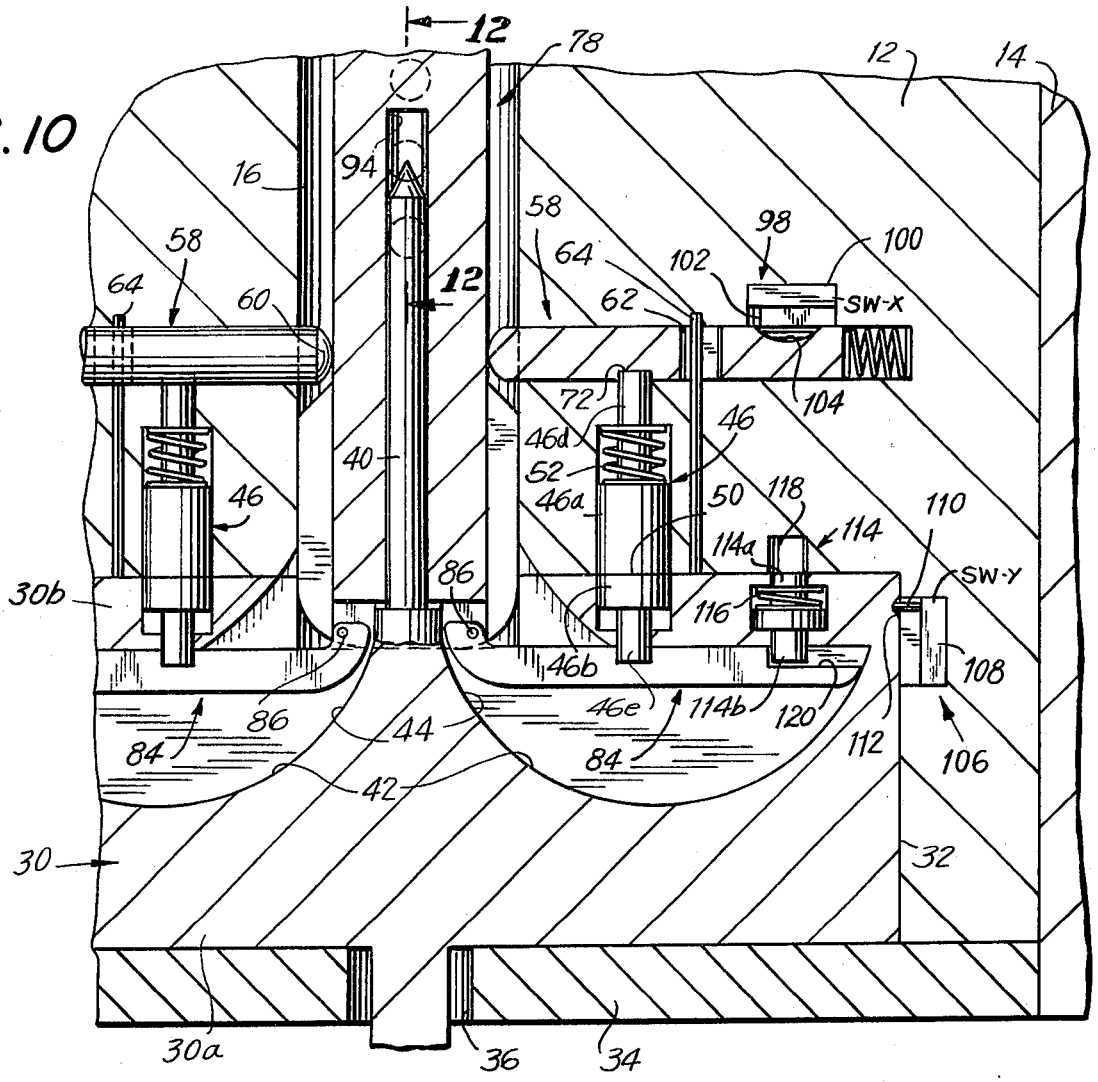
FIG. 10 is similar to FIG. 7, except that a pick-proof plunger is provided which locks the cylinder upon improper actuation thereof, and further showing switches which monitor the positions of the enabling biased pins and revolving cylinder to activate an alarm system when any of the moving elements within the lock cylinder are improperly activated, and further showing the relative positions of sensing rods which also cooperate with the alarm system and are more fully shown in FIGS. 12–16.

Referring to FIG. 10, a presently preferred embodiment of the present invention includes alarm actuation or switch means 98 in the form of switches 100 for monitoring the position of the enabling biased pin 58. Normally, a susggested above, the biased pin 58 is urged inwardly into the keyhole 16 by means of suitable biasing means, such as the spring 66. Any illicit attempt at movinfg the enabling biased pin 58 may be used to trigger an alarm system connected to the alarm actuating means 98 which includes the switch 100 having a detection means or feeler 102 which monitors the position of a recess 104 formed in the enabling biased pin 58. When the switch 100, denominated "SW-X" is used in a closed loop-type alarm system, th4 switch 100 can be a normally closed switch in the normal condition of the enabling biased pin 58 prior to insertion of a key or other implement. The type of switch utilized will be determined by the type of alarm system with which it is used, and any initial switch condition may be selected. The only important characteristic of the switch 100 is that it changes its state from the initial position of the enabling biased pin 58 to any other position thereof. Without the additional circitry to be described hereafter, the arrangement shown in FIG. 10 will cause an alarm to be triggered whenever the pin 58 is moved, whether this be by a properly coded key or otherwise. However, as will be explained below with reference to the other Figures, there is advantageously provided additional switch means for disabling the alarm system only when a properly coded key is inserted into the lock.

Still referring to FIG. 10, the presently preferred embodment includes an additional switch means generally designated by the reference numeral 106 connectable to the alarm circuit for disabling the same upon actuation of the additional switch means by an appropriately jointed key. One form of such additional swtich means includes a switch 108 having a feeler 110 which is arranged to monitor the position of a recess 112 formed in the revolving cylinder 30. The switch 108 is denominated "SW-Y" and is normally open when the feeler 110 is received within the recess 112 in the example shown. However, as will be evident to one skilled in the art, the switch 108 may be normally closed, this depending upon the type of alarm system used and the specific circuitry used therein. The switch 108 serves the function, as will become evident hereafter, of disabling the alarm circuit means in all relative angular positions between the revolving cylinder 30 and the external housing 12 except that which corresponds to the locked position of the revolving cylinder 30.

There is also provided in the presently preferred embodiment at least one pick-proof plunger or pin generally designated by the reference numeral 114 in FIG. 10. The pick-proof plunger 114 is biased by a spring 116 or other suitable means to normally position the pick-proof plunger substantially within the revolving cylinder 30. In this normal position, the pick-proof plunger 114 does not bridge the first junction plane 32 and is not received within a coaxial opening 118 provided in alignment therewith. While one pick-proof plunger 114 is shown, it should be evident that any number of such pick-proof plungers may be utilized in the lock cylinder of the present invention. The pick-proof plunger 114, therefore, does not interfere with the relative rotation of the revolving cylinder with respect to the external housing 12 in the normal retracted position thereof. However, when the pick-proof plunger 114 is actuated and moved to any appreciable degree, at least a portion thereof bridges the first junction plane 32 and enters the opening 118 to prevent relative rotation of the cylinder 30 with respect to the external housing 12. The coded finger 84 shown in FIG. 10 is shown provided with a cut-out portion 120 which is arranged in such a manner so that when the coded finger 84 is in its final position, it still fails to actuate or in any way move the pick-proof plunger 114. Accordingly, it should be clear that any coded finger 84 which is used in conjunction with a lock cylinder 10 having one or more pick-proof plungers 114 must be provided with surfaces 120 which fail to actuate the pick-proof plungers in the fully inserted position of the key. Accordingly, it should also be evident that any attempt to pick the lock of the present invention by simply trying to actuate and move all of the plungers or pins will simultaneously depress the pick-proof plungers 114 to thereby lock the revolving cylinder within the external housing 12 irrespective of any other action which may take place within the lock.

Figure 12:
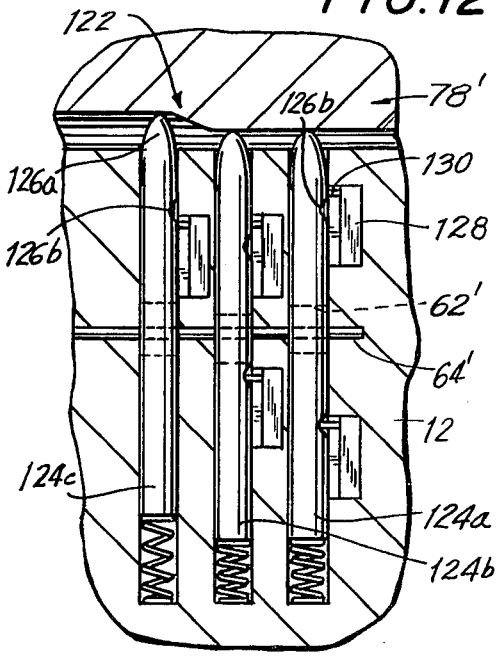
FIG. 12 is a fragmented cross-sectional view taken along line 12—12 in FIG. 10, and shows by way of illustration the manner in which the sensing rods cooperate with the coded shank of the key shown in FIG. 11 to disable an alarm only when the sensing rods are actuated by a properly coded key.

Alarm switch means 98 and 106 have been described above which respectively actuate an alarm and disable the alarm upon rotation of the revolving cylinder 30. The lock cylinder 10 of the present invention can be adapted in numerous other ways for providing alarm signals or for disabling the same. For example, by way of further illustration, reference is made to FIG. 11 and FIG. 12. In FIG. 11, a modified jointed key 74' is shown which has a coded shank 78' to be more fully described. The coded shank 78' is provided, at the leading axial end 78' thereof, with a coding step 122 within one of the axial alignment grooves **90*a*–90*d*. When such coding steps 122 are utilized, the additional switch means, which may be in place of or in addition to the switch means 106, is mounted on the external housing 12 for monitoring the shank 78' of the jointed key 74'. The additional switch means, as with the disabling switch means 106, disables the alarm circuit means only upon insertion of an appropriately coded shank into the keyhole. More specifically, the alternate form of switch means comprises at least one but preferably a plurality of biased slidable sensing rods 124*a*–124*c* mounted on the external housing 12 and having at least free end portions 126*a* projecting into the keyhole 16. The slidable sensing rods 124*a*–124*c* are movable a predetermined amount only upon engagement with a suitably coded shank 78'. Cooperating with the slidable sensing rods 124*a*–124*c* are a plurality of switches 128 which include detecting means in the form of feeler elements 130 which monitor the relative positions of recesses 126*b* formed within the slidable sensing rods 124*a*—124*c* as shown in FIG. 12. As with the enabling biased pin 58 and the switch 100 shown in FIG. 10, the coded step 122 on the shank 78' causes the slidable sensing rods 124*a*–124*c* to move predetermined distances only upon engagement with a suitably coded shank and in the appropriate preselected sequence for disabling the alarm circuit means. Any actuation of a slidable sensing rod which causes the same to move excessively or insufficiently, as well as actuating the sensing rods in the wrong order, causes the alarm to issue. While the coded shank 78' is shown to have only single coded step 122, it should be evident that any number of coded steps can be utilized, each representing a different diameter or dimension of the shank. Advancement of the key 74' through the keyhole 16 causes the coded step 122 to successively engage and press in the slidable sensing rods 124*a*–124*c***.

In view of the fact that any number of slidable sensing rods may be used and any number of coded steps may be used on the coded shank 78', and in view of the fact that any number of switches 128 may be used which cooperate with the slidable sensing rods, it should be evident that the number of switching combinations are very numerous. What will now follow is a brief explanation of only several examples, these being given only by way of illustration and are not intended to limit the scope of the invention in any way.

Figure 13E:
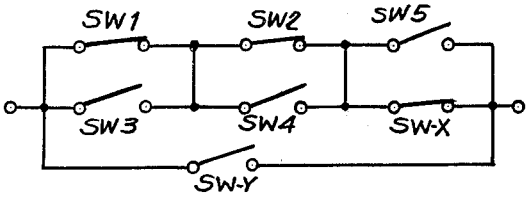
FIG. 13*e* is a schematic representation of the switches shown in FIGS. 13*a*–13*d* as well as the switches shown in FIG. 10, the switch positions shown being those existing prior to insertion of the key into the keyhole.
Figure 14F:
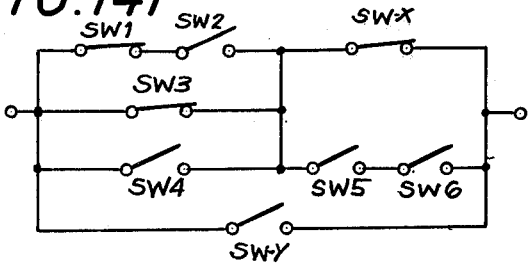
FIGS. 14*f*, 15*f* and 16*e* are the corresponding schematic diagrams therefor and showing the initial switch conditions in the respective drawings prior to insertion of the key.

Referring to FIGS. **13*a*–13*d*, there are shown four views of the same sensing rods in successive positions as the coded shank 78' is advanced into the keyhole 16**. "*A*", "*B*", *and* "*C*". Also, the various switches associated with the slidable sensing rods are denominated "SW1" through "SW5". The schematic representation of the electrical circuit embodied by the various switches shown in FIGS. **13*a*–13*d* is shown in FIG. 13*e*, the positions of the switches being those in the normal conditions of the same before a key is inserted into the keyhole 16. In FIGS. 13*a*–13*d*, the switches are normally open when the feeler elements of these switches are out of the associated recesses in the sensing rods and are closed when they are received therein. Referring to FIG. 13*e*, this schematic diagram shows that in the initial positions of the sensing rods, only the switches SW1, SW2 and SWX are closed. As will become evident, the successive actuation of the sensing rods by the coded steps 122 and 122*a* will change the conditions of the switches to constantly provide a short circuit between the terminals of the circuit shown in FIG. 13*e*. Thus, it should be evident that actuation or movement of the enabling biased pin 58 (switch SWX) or either of the sensing rods "A" or "B" (switches SW1 and SW2 respectively) will trigger the alarm since it will present an open circuit between the circuit terminals shown in FIG. 13*e***.

Figures 13A, 13B, 13C, 13D, 14A, 14B, 14C, 14D, 14E, 15F:
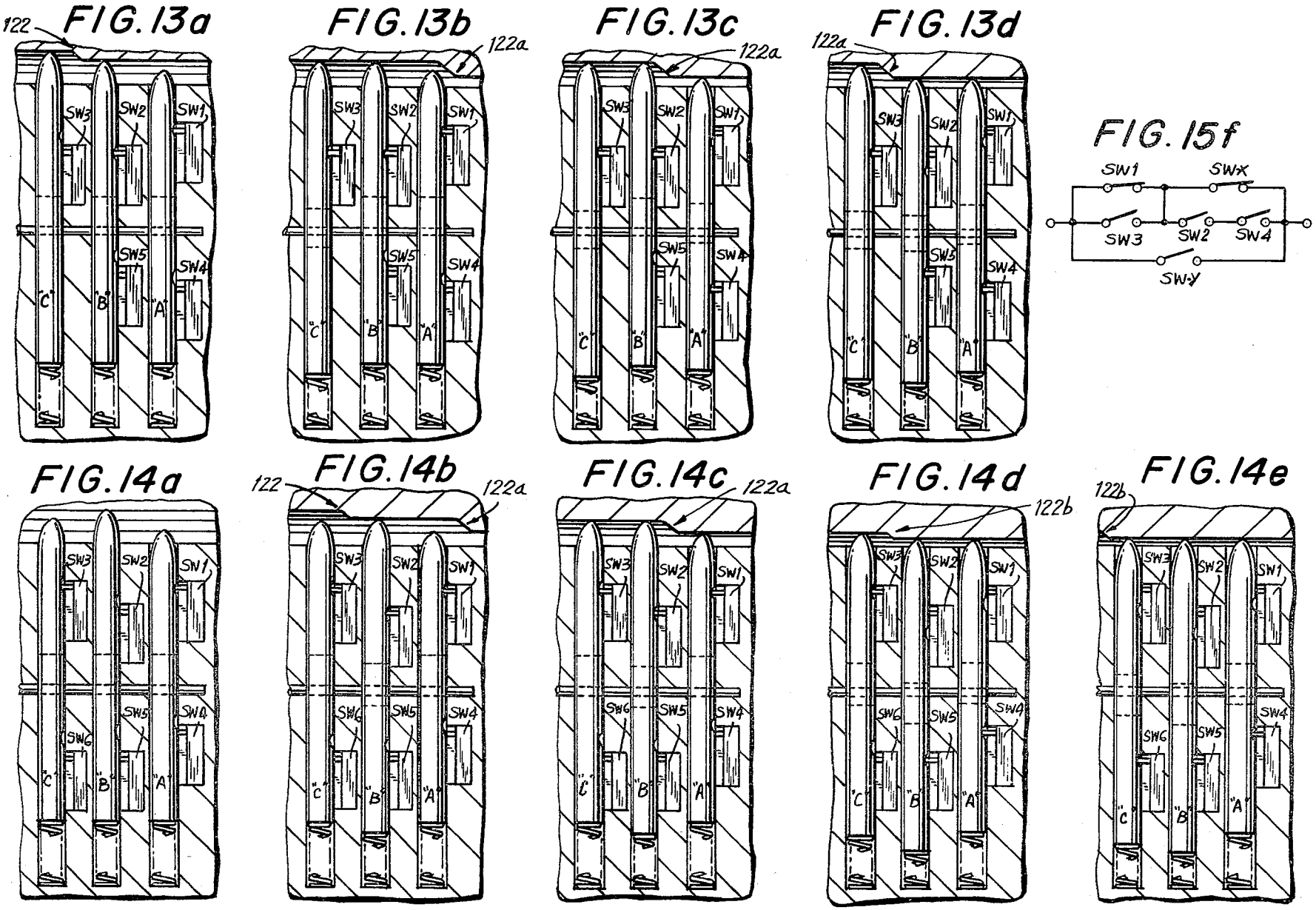
FIGS. 13*a*–13*d* are similar to FIG. 12 and illustrate the manner in which the alarm sensing rods are successfully actuated and sequenced by an appropriately coded shaft of a jointed key to prevent an alarm from being issued.
FIGS. 14*a*–14*e*, 15*a*–15*e*, and 16*a*–16*d* are similar to FIGS. 13*a*–13*d*, and show different arrangements or combinations of switches and shank codings.
Figures 15A, 15B, 15C, 15D, 15E, 16A, 16B, 16C, 16D, 16E:
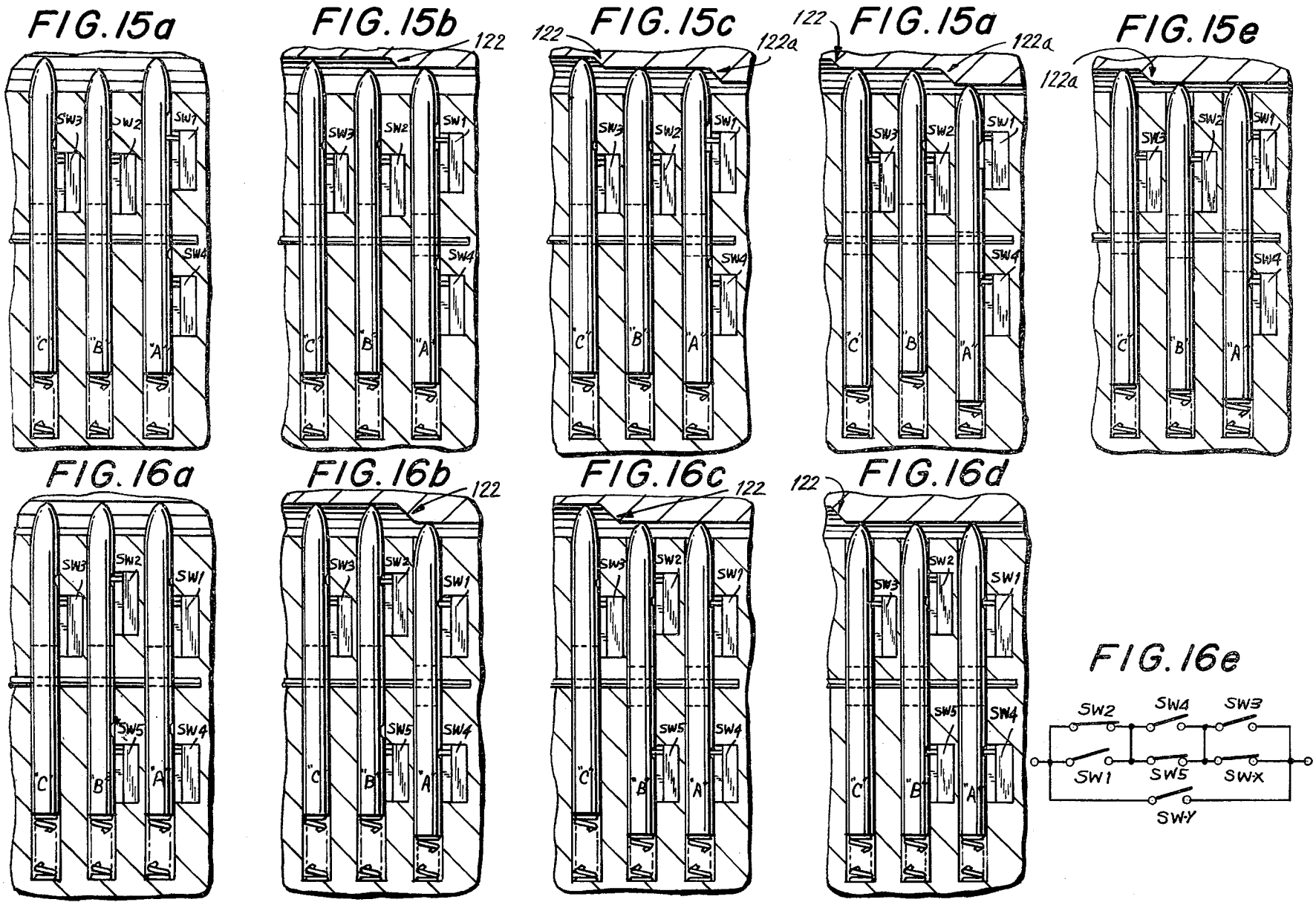

In FIG. **13*a*, it will be noted that the sensing rod "C" extends sufficiently into the keyhole 16 so that advancement of the coding step 122 causes the sensing rod "C" to be pushed inwardly, as shown in FIG. 13*b*. Such movement causes the switch SW3 to move from its initial open to its closed condition upon entry into its associated recess. Since switches SW1 and SW3 are connected in parallel, it is now possible to open switch SW1 without triggering the alarm. In FIG. 13*b*, the sensing rod "A" is shown to extend sufficiently into the keyhole 16 so as to engage successive coding steps 122*a* and, in FIG. 13*c***, the sensing rod "A" is shown to be pushed radially outwardly against the action of its biasing spring. Such movement of the sensing rod "A" causes the switch SW1 to open and the switch SW4 to close. Since switches SW2 and SW4 are in parallel with each other, it is now permissible to open switch SW2 without triggering the alarm.

Referring again to FIG. **13*c*, the sensing rod "B" is shown about to engage the second coding step 122*a*, and in FIG. 13*d***, such second coding step has urged the sensing rod "B" to be forced outwardly against the action of its biasing spring. Such movement of the sensing rod "B" causes the switch SW2 to open and the switch SW5 to close. Again, since the switches SW5 and SWX are in parallel to each other, it is now permissible to open switch SWX without triggering the alarm circuit.

Once the key has passed the initial detection means, namely the sensing rods "A"–"C", it engages the enabling biased pins 58 which, as described in conjunction with FIG. 10, causes the switch SWX to go from the normally closed to the normally open condition. However, since the switch SW5 which is in parallel therewith has been closed, the alarm circuit is maintained deactivated.

As noted above, there is advantageously provided a revolving cylinder alarm disabling means 106 which senses the relative positions of the revolving cylinder 30 and the external housing 12. When a switch 108 (SWY) is used, it is connected as shown in FIG. **13*e* to assure that a short is preserved across the circuit terminals irrespective of the action of the switch SWX due to possible minor variations in diameter of the coded shank 78'. The switch SWY is normally in the open condition when the revolving cylindeer 30 as in its initial or locked position. However, clearly, as soon as a coded key is inserted and the revolving cylinder 30** is rotated, the switch SWY is closed so as to short all of the other switches and prevent an alarm from issuing irrespective of any other movements of pins or sensing rods subsequent to actuation of the revolving cylinder.

Referring to FIGS. 14*a*–14*f*, this illustrates another arrangement of coding steps and sensing rods. However, in this arrangement, there are six switches "SW1"–"SW6" which cooperates with six recesses in the sensing rods. It should be evident to one skilled in the art that proper actuation and sequencing of the sensing rods shown in FIGS. 14*a*–14*e* will cause the respective switches SW1–SW6 and SWX and SWY to open and close in the required manners to always maintain a short circuit across the circuit terminals. This will again prevent issuance of an alarm as long as a properly coded key is inserted into the keyhole which has both a properly coded shank 78' as well as properly coded fingers which actuate the cylinder into rotation.

Additional examples of sensing rod and switch arrangements are shown in FIGS. 15*a*–15*e* as well as in 16*a*–16*e*. These further examples are similar to the ones already described and operates substantially the same way. In each case, it is important that the coding steps on the shank 78' depress the sensing rods a preselected amount and in the correct sequence to actuate successive switches associated with the sensing rods to always maintain a predetermined circuit condition. It will be evident that the predetermined circuit condition can be selected to be a normally closed condition or a normally open condition depending upon the alarm circuit with which the lock is used. Additionally, while some of the switches have been describes as being normally closed when their associated feeler elements are received within the recesses, it will be noted that the switch "SW5" in FIGS. 16*a*–*16d* is normally open when its feeler element is received within its associated recess. Otherwise, the circuits operate essentially in the same way to produce substantially the same result.

The decoding plungers 46 described in connection with the lock cylinder 10 are mounted on the lock cylinder 10 in any conventional manner for siding movements of the type described. In the presently preferred embodiment, the plungers or pins 46 are mounted within bores provided with shoulders of the type generally shown in U.S. Pat. No. 1,567,979. An alternate method of mounting these plungers or pins, instead of using shoulders and bores, is to utilize limiting pins and slots of the type shown in connection with the enabling biased pin 58. Clearly, any other construction whereby a stop means may engage a portion of a sliding pin or plunger can similarly be used, including an abutment means which is adapted to engage any surface portions of the pins or plungers.

While the above-described embodiments utilize mechanically actuated decoding pins or plungers, it should be clear that any other form of decoding means may be used. Numerous types of decoding means are known in the prior art. These include magnetic decoding means, photoelectric decoding means, electret decoding means or any other arrangement which can detect a properly coded key to provide an enabling or inhibiting function. Thus, any mechanical, photoelectric, electronic, electric, or magnetic types may be used.

The discussion with respect to FIGS. 18–25 relates to an alternate form of decoding means, namely the type which relies upon sensing of force fields produced by magnets or electrets. While the Figures will be described in terms of magnetic shields, it will be evident to one skilled in the art that whenever reference is made to a magnet, the same element can be any other force field producing material, so long as the coded key or finger 84 can be coded to produce a force field to which the enabling or decoding pins or plungers are responsive.

Figures 18, 19, 20, 21:
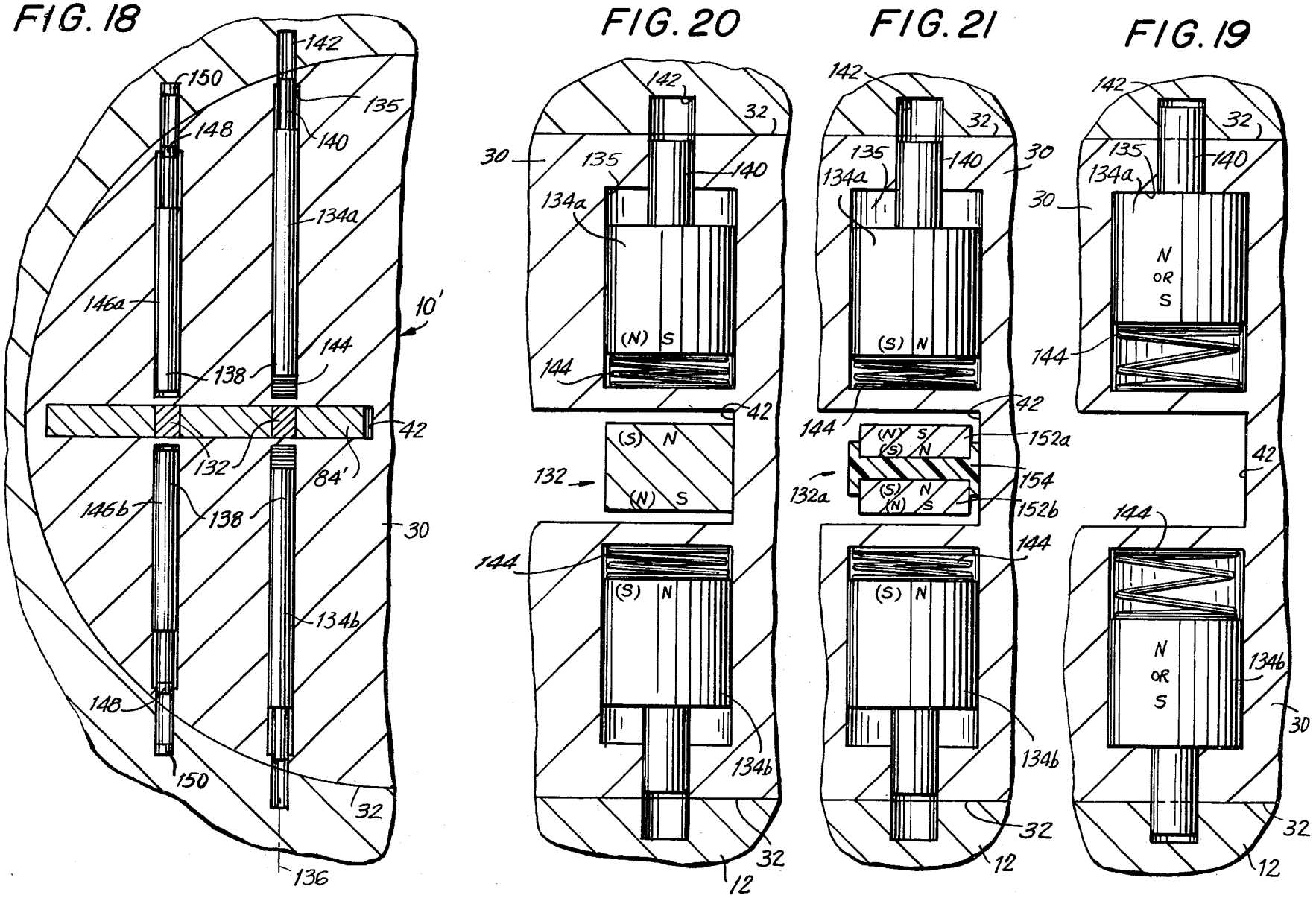
FIG. 18 is a fragmented cross-sectional view taken along lines 18—18 in FIG. 7, and showing the use of force field activatable decoding pins in place of or in addition to the contact-actuated plungers or pins shown in FIG. 1.
FIG. 19 is an enlarged fragmented cross-section of a portion of the revolving cylinder shown in FIG. 18, and showing the initial positions of two force field activated decoding pins in their locking positions prior to insertion of a key.
FIG. 20 is similar to FIG. 19, but showing a force field coded finger disposed between the decoding pins to move the same from the locking to the releasing positions thereof.
FIG. 21 is similar to FIG. 20, except that a modified force field producing finger is shown which permits actuation of two similar force field responsive portions on the two opposing decoding pins.

Referring now to FIG. 18, there is shown a modified lock cylinder 10' in which force field actuatable decoding pins are utilized. The pins 134*a*, 134*b*, 146*a* and 146*b* are slidably mounted within elongate holes 135 in the revolving cylinder 30 for movement between locking and releasing positions. The decoding pins in FIG. 18 are shown in their releasing positions in response to the insertion of a properly coded key. The decoding pins 134*a* and 134*b* are coaxially aligned with each other along an axis 136 which is substantially normal to the plane defined by the cam surface 42, the decoding pins 134*a* and 134*b* being provided and spaced from each other on opposite sides of the cam surface. The decoding pins 146*a* and 146*b* are similarly coaxially aligned with each other along an axis parallel to the axis 136 and are also positioned on opposite sides of the cam surface 42 as shown. While FIG. 18 only shows one magnetically coded finger 84', it is, of course, possible to provide a similar arrangement with respect to a second coded finger which is formed on the same jointed key. Only one-half of the lock is shown in FIG. 18 for the sake of simplicity. Additionally, while four decoding pins are shown, it should be evident that any number may be utilized, including only one such pin or a large number of pins.

Each decoding pin in FIG. 18 is provided with a force field responsive portion 138 at one free end thereof proximate to the cam surface 42. As suggested above, such force field responsive portion 138 can be either a magnet, an electret, or merely a portion of material which is responsive to a magnetic or electrostatic force. The opposite free end 140 of each decoding pin is configurated to be receivable within an opening 142 in the external housing 12 during the locking mode of the decoding pins.

As with the plungers 46, the decoding pins 134*a*, 134*b*, 146*a*, 146*b* are provided with biasing means for biasing the decoding pins to urge the same to the locking position by bringing the free ends 140 into the openings 142. In these positions, the free ends 140 bridge the gap 32 between the revolving cylinder 30 and the external housing 12. Such biasing means may be of any suitable or conventional type and, with respect to the decoding pins 134*a* and 134*b*, are shown as springs 144. By way of further example, the biasing means with respect to pins 146*a* and 146*b* is in the form of a magnet 148 mounted on the decoding pins and a magnet 150 fixedly mounted within the external housing 12, and more specifically within the opening 142. The portions of the magnet 148 and 150 which are proximate to each other are, in this case, of opposite polarity so as to attract each other and, therefore, urge the decoding pins to their locking positions.

In FIG. 18, a properly coded finger 84' is shown within the cam surface 42 area and in a position which places the force field producing material portions 132 on the coded key proximate to the force field responsive portions 138 of the decoding pins. Only when the proper force field is established in the regions of the force field responsive portions, do they slidably move to their releasing positions against the forces of the biasing means. In order to achieve this action, in FIG. 18, the portions 132 may be magnets which attract proximate portions of the decoding pins which are of opposite polarity. Where the portions 132 are magnets, it is also possible to attract the decoding pin when the portions 138 are merely made of magnetizable material. However, the pulling forces will not be as strong in that instance and the use of magnets or magnetized portions on the decoding pins is preferred. Clearly, just as the portions 132 can be used to establish a force field which acts upon a portion on the decoding pins, the reverse can also be true, so that the force field producing portions can be on the decoding pins themselves. In FIG. 18, the force field producing portions 132 simultaneously actuate each of the pair of decoding pins 134*a* and 134*b* in the final position of the coded finger 184'.

While the embodiment shown in FIG. 1 only shows contact actuated plungers or pins 46 and the embodiment shown in FIG. 18 only shows force field activated decoding pins, it should be evident that both of these types of pins can be used in combination with each other within the same lock. In such an instance, however, the coded key must be provided with the requisite abutment surface portions 88 as well as the force field producing portions 132. Also, the present invention contemplates that the contact actuated decoding pins 46 as well as the force field actuated decoding pins can be positioned and oriented in any desired manner about the revolving cylinder 30, so long as these pins are mounted to bridge the first junction plane 32 in the manner described to lock or release the revolving cylinder upon actuation by a properly coded key.

Referring now to FIGS. 19–21, there is shown, by way of example only, some typical arrangements of force field actuated decoding pins and possible ways in which these pins can be arranged and actuated. In FIG. 19, the decoding pins 134*a* and 134*b* are shown in their normally locking positions due to the biasing by springs 144. In FIG. 20, a simple magnet 132 which may form part of a coded finger is inserted between the decoding pins and has polarities which attract the decoding pins. Thus, if the decoding pin 134*a* has the innermost portion thereof polarized with a south pole and the decoding pin 134*b* has the innermost portion thereof polarized with a north pole (designated by "S" and "N" respectively), a properly coded finger 132 will be polarized north (N) and south (S) as shown to attract these two decoding pins and move the same to their releasing positions. The polarities shown in parentheses are exemplary of another set of polarities which will achieve the same function.

With the polarities shown in FIG. 20, the decoding pin portions proximate to the cam surface 42 are of opposite polarity. In FIG. 21, the coded finger 132*a* is shown to be formed of two separate magnets 152*a* and 152*b* mounted on and separated by a magnetizable material 154, such as soft iron. With this arrangement, the decoding pins 134*a* and 134*b* can be of the same polarities in the regions proximate to the cam surface 42, as illustrated by the polarity designations in that Figure. Insertion of the coded finger 132*a* into the lock will cause the decoding pins to be brought to their releasing positions as shown.

Figures 22A, 22B, 23, 24, 25:
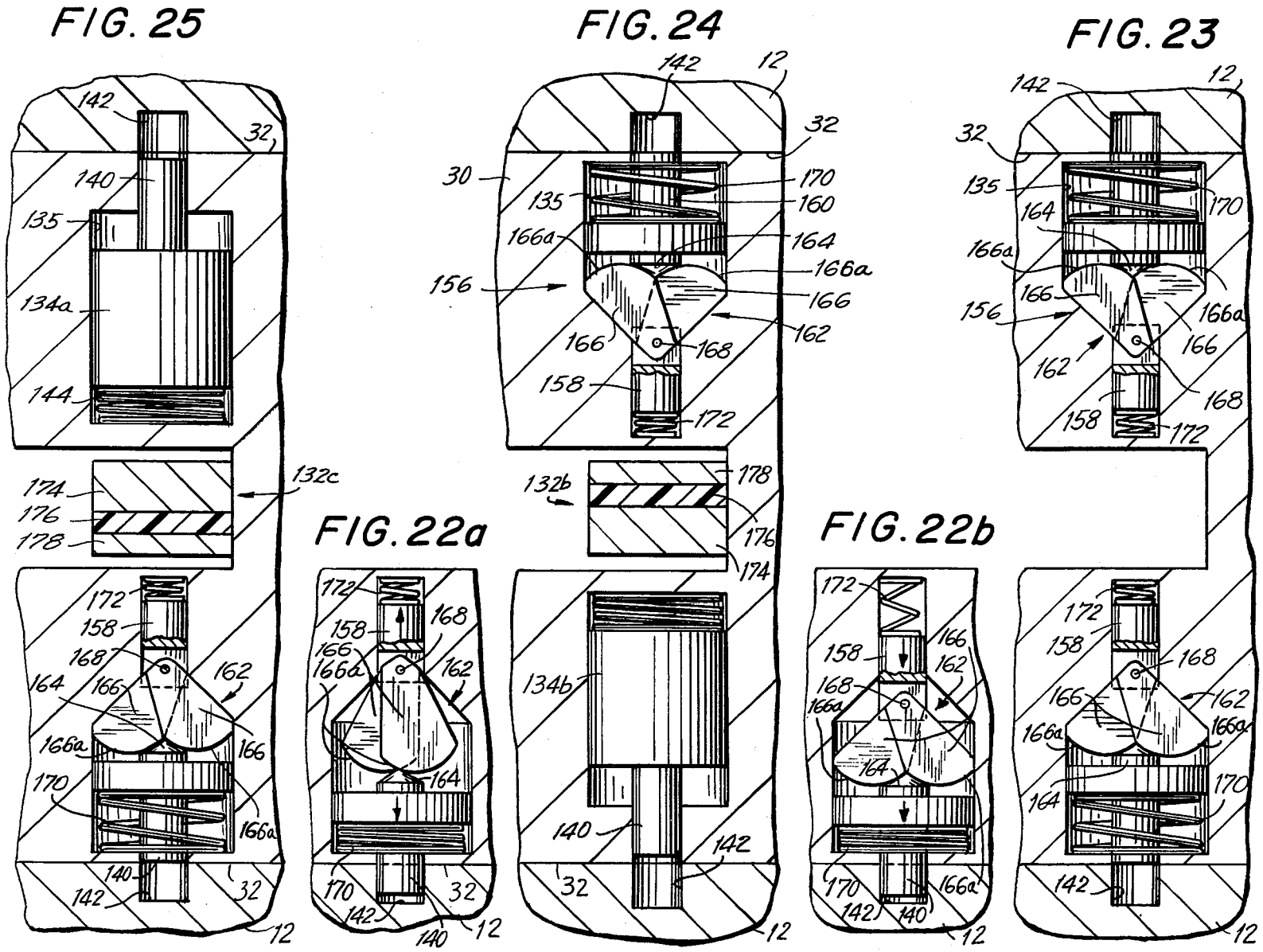
FIGS. 22*a* and 22*b* illustrate force field activated pick-proof pins which are normally in their releasing positions, but which move to their locking positions upon being attracted to or repelled from an improperly decoded key.
FIG. 23 is similar to FIG. 19, but showing two pick-proof pins of the type shown in FIGS. 22*a* and 22*b*.
FIG. 24 illustrates one combination which utilizes one pick-proof pin on one side of the coded key and a force field responsive decoding pin on the other side thereof, and a possible construction of a decoding key for use with such a combination.
FIG. 25 is similar to FIG. 24 but showing the pick-proof pin and force field responsive decoding pin interchanged, also showing the modifications to the coded key for use with such new combination.

As with the contact actuated plungers, the present invention also contemplates the use of force field actuated pick-proof pins. One example of such pick-proof pins are shown in FIGS. 22*a* and 22*b*. The force field actuated pick-proof pins are also slidably mounted within a generally elongate hole formed in the revolving cylinder 30. The pick-proof pins include a portion responsive to a force field on a coded finger, similar to those on the decoding pins 134*a* and 134*b*. The pick-proof pins also include locking portions which are movable between releasing and locking positions, similar to those on the enabling or decoding pins. However, the pick-proof pins also include motion translation means cooperating with the force field responsive portions urging the locking portions into the locking positions upon any axial movement of the force field responsive portions. The biasing means used in conjunction with the pick-proof pins are selected to urge the locking portion to the releasing positions thereof so that the pick-proof pins are normally contained within the generally elongate holes 135 in the revolving cylinder. Thus, the pick-proof pins do not interfere with the rotation of the revolving cylinder unless an improperly coded key is inserted into the lock to either attract or repel the pick-proof cylinders. In either case, the locking portions of the pick-proof cylinders are urged by the motion translation means into an appropriately aligned opening or hole 142 within the external housing 12.

The forces established by the biasing means can be selected so that the pick-proof pins will respond only to a force field producing material or to a force field producing material and a force field responsive material.

By way of example only, there is illustrated in FIGS. 22–25, one type of magnetic pick-proof pin generally designated by the reference numeral 156. The pick-proof pin 156 includes a force field responsive portion 158 proximate to the cam surface 42 region and a locking portion 160 similar to those described above in connection with both the contact and force field responsive pins. The motion translation means 162 is in the nature of a cam follower 164 forming part of the locking portion 160 and a pair of cam blades 166 which include cam surfaces 166*a*. In their normal positions, shown, for example, in FIG. 23, the cam blades 166 are at their extreme outward positions as shown, wherein the cam follower 164 abuts on a low point of the cam surfaces 166*a*. In FIG. 22*a*, the pick-proof pin is shown to be attracted by an improperly coded material and, inward movement of the force field responsive portion 158 causes the cam blades 166 to collapse and further overlap each other to cause the cam follower 164 to ride to a higher point on the cam surfaces 166*a* to thereby outwardly move the locking portion 160 against the biasing forces established by the spring 170. As soon as the improperly coded key is removed from the lock cylinder, the biasing spring 172 returns the force field responsive portion 158 and the motion translation means 162 back to their original and normal positions. At such time, the biasing spring 170 causes the locking portion 160 to return to its releasing position. In FIG. 22*b*, the pick-proof pin 156 is shown when an improperly coded key repels the force field responsive portion 158. In this case, the cam blades 166 remain in their normal positions, except that the entire pick-proof pin 156 moves outwardly to urge the locking portion 160 to its locking position against the forces of the biasing spring 170.

FIG. 23 is similar to FIG. 19, except that two pick-proof cylinders are shown on opposite sides of the cam surface 42 region. As suggested above, the springs 170 and 172 may be selected so as to permit movement of the pick-proof pins when either a magnet and a magnetizable material or only a magnet is inserted between these pins. In FIG. 24, a pick-proof pin 156 is shown on one side of the cam surface region, while a decoding pin 134*b* is shown on the other side thereof. When this arrangement is used, the biasing means or springs 170 and 172 are selected so that the pick-proof pins move only in response to a magnet. The coded finger 132*b* shown in FIG. 24 includes a magnet 174, a non-magnetic material 176 sandwiched between the magnet 174 and a magnetizable material 178. The magnetizable material layer 178 essentially shields the pick-proof pin 156 from the magnet 174 so that the magnet 174 does not appreciably move the pick-proof pin 156, although it is effective to move the decoding pin as described above to unlock the revolving cylinder. An improperly coded key having an construction different from that shown in FIG. 24 will either cause the pick-proof pin 156 to move to its locking position or fail to move the decoding pin 134*b* to its releasing position. FIG. 25 shows an arrangement similar to that shown in FIG. 24, but showing the positions of the pick-proof pin and the decoding pin reversed. Now, clearly, the coded finger 13*c* must be modified to reverse the order of the various layers, so that the magnet 174 again faces the decoding pin, and the magnetizable layer 178 faces the pick-proof pin. Use of the coded finger 132*b* in the arrangement shown in FIG. 25 or the use of the coded finger 132*c* in the arrangement shown in FIG. 24 would not effect an unlocking action but would cause the lock cylinder to remain locked. Only when a finger is coded for a specific arrangement of decoding and pick-proof pins will the lock be actuated.

Since the decoding pins can be polarized to have either a north or south portion proximate to the cam surface region, and since the pick-proof pins are arranged to respond to either polarity, it should be evident that there are nine possible combinations of arrangements for each pair of opposing decoding pins and/or pick-proof pins.

Where force field producing materials are utilized on coded fingers, it is also contemplated by the present invention that the force fields produced can be modified in any conventional manner to thereby alter the combinations of the lock. Thus, for example, if a force field producing portion comprises a magnet having north and south pole, the polarities on that magnet could be reversed by conventional means to alter the orientation of the magnet to make the south pole the north pole and the north pole the south pole. This will change the combination of the lock. To achieve this, by way of example only, it is contemplated to utilize an erase and write key generally similar in configuration to the jointed key shown in FIG. 3, but which includes electromagnetic portions thereon so that when the key is fully inserted into the lock, suitable demagnetizing fields can be generated proximate to the various force field producing portion within the lock. This would erase the pre-existing polarities and, in similar manner, new polarities can be imparted to these field producing portions.

With respect to the alarm producing and inhibiting means described above with respect to FIGS. 10–16, the switches are shown, but the means for mounting the same and the electrical leads which emanate therefrom are not shown. These switches may be mounted in any conventional manner and it is to be understood that these switches include electrical leads which are interconnected in the manners suggested in the schematic diagrams 13*e*, 14*f*, 15*f* and 16*e*.

It is to be understood that the foregoing description of the various embodiments illustrated herein is exemplary and various modifications to the embodiments shown herein may be made without departing from the spirit and scope of the invention.

What is claimed is:

1. A lock cylinder for use with a jointed key generally defining an axis and having at least one pivotally mounted coded finger which is movable between an initial position substantially parallel to said axis and a final position substantially normal to said axis, said lock cylinder comprising an external housing having two coaxial cylindrical cavities in communication with each other, one of said cylindrical cavities defining a keyhole for the jointed key and having an opening to the exterior of said external housing at one end and a remote end proximate to the other of said two cavities, said keyhole having a diameter generally smaller than that of said other cavity; a revolving cylinder disposed beyond said remote end of said keyhole and having a diameter generally corresponding to that of said other cavity and mounted only for free coaxial rotation therein; means mounted on said revolving cylinder for common rotation therewith and adapted to cooperate with an associated lock mechanism, said revolving cylinder being provided with at least one cam surface generally facing said one of said cavities and having a surface portion proximate thereto whereby insertion of the jointed key into said lock cylinder causes said finger to initially abut against said cam surface portion, said cam surface being configured to move said finger from said initial position to said final position upon full insertion of the jointed key into said lock cylinder; and decoding means spaced from the axis of said cavities and cooperating with said external housing and said revolving cylinder for normally preventing said revolving cylinder from rotating relative to said external housing and permitting the same to rotate only when said decoding means detects an appropriate code on said finger in said final position of said finger.

2. A lock cylinder as defined in claim 1, wherein said cam surface is generally continuously curved.

3. A lock cylinder as defined in claim 2, wherein said cam surface is generally circular.

4. A lock cylinder as defined in claim 1, wherein said mating surfaces of said external housing and of said revolving cylinder define a first junction plane, and wherein said decoding means comprises at least one biased plunger consisting of two axially aligned portions which together define a second junction plane, said first and second junction planes normally being out of alignment and being placed into alignment only when said plunger responds to an appropriately coded jointed key.

5. A lock cylinder as defined in claim 4, wherein the jointed key has a shank having predetermined cross-sectional dimensions, and further comprising enabling means slidably mounted in said external housing and having at least a portion thereof projecting into said keyhole for detecting said predetermined cross-sectional dimension of the jointed key and for enabling said at least one plunger to move to the aligned condition of said junction planes only upon detection of said predetermined cross-sectional dimension of the jointed key shank.

6. A lock cylinder as defined in claim 5, wherein said at least one plunger has a free end portion thereof extending proximate to said enabling means, said enabling means comprising a biased pin generally radially oriented with respect to said keyhole and having at least one recess therein dimensioned to freely receive said plunger free end portion when an appropriately coded shank and finger respectively actuating said biased pin and said at least one plunger to bring said at least one recess and plunger free end portion into alignment.

7. A lock cylinder as defined in claim 6, wherein a plurality of plungers are provided, and a plurality of spaced recesses are provided in said biased pin, said plurality of plungers being arranged and spaced from each other to generally correspond to the spacings between said recesses and to substantially simultaneously cause the free end portions of the respective plungers to be received within the corresponding recesses upon actuation of a suitably coded key.

8. A lock cylinder as defined in claim 6, further comprising at least one pick-proof plunger housed in said revolving cylinder and mounted for sliding movement between a normal position wherein said pick-proof plunger does not bridge said first junction plane and does not interfere with the relative rotation of said revolving cylinder with respect to said external housing, and a locking position when said pick-proof plunger is activated by an improperly coded jointed key to bridge said first junction plane and prevent the relative rotation of said revolving cylinder with respect to said external housing.

9. A lock cylinder as defined in claim 5, further comprising alarm actuating means connectable to appropriate circuit means for providing a signal upon actuation of said enabling means.

10. A lock cylinder as defined in claim 9, wherein said alarm actuating means comprises switch means for monitoring the position of said enabling means.

11. A lock cylinder as defined in claim 10, further comprising additional switch means connectable to said circuit means for disabling the same upon actuation of said additional switch means by an appropriately coded jointed key.

12. A lock cylinder as defined in claim 11, wherein said additional switch means is arranged to monitor the relative angular positions of said revolving cylinder relative to said external housing, said additional switch means disabling said circuit means in all relative angular positions between said revolving cylinder and said external housing except that corresponding to the locked position of said revolving cylinder.

13. A lock cylinder as defined in claim 11, wherein the shank of the jointed key is coded and wherein said additional switch means is mounted on said external housing for monitoring the shank of the jointed key, said additional switch means disabling said circuit means only upon insertion of an appropriately coded shank into said keyhole.

14. A lock cylinder as defined in claim 13, wherein said switch means comprises at least one switch mounted on said external housing and having detection means, and a slidable sensing rod having at least a free end portion thereof projecting into said keyhole and being movable a predetermined amount only upon engagement with a suitably coded shank of a jointed key to actuate said detection means of said at least one switch for disabling said circuit means.

15. A lock cylinder as defined in claim 14, wherein a plurality of switches are mounted on said external housing, and a plurality of slidably mounted sensing rods are provided each associated with another respective switch, said switches being interconnected with each other to disable said circuit means only when said slidably mounted sensing rods are actuated in a predetermined sequence and are each moved a predetermined amount.

16. A lock cylinder as defined in claim 4, wherein said at least one plunger comprises three axially aligned portions to define second and third junction planes, said third junction plane being brought into alignment with said first junction plane when said at least one plunger is actuated by a suitably coded master key.

17. A lock cylinder as defined in claim 11, in combination with said jointed key, said jointed key having a generally elongate cylindrical shank having a gripping portion at one axial end thereof, and having at least one coded finger pivotally mounted on the other axial end thereof, said cylindrical shank being provided with at least one external circumferential groove associated with said enabling means, and at least one external groove substantially parallel to the axis of said shank and associated with said disabling means.

18. A lock cylinder as defined in claim 17, wherein the code on said coded finger comprises at least one abutment surface portion disposed on said coded finger to abut aginst said at least one biased plunger an arranged to move said at least one biased plunger to the aligned condition of said junction planes in said final position of said coded finger.

19. A lock cylinder as defined in claim 17, further comprising alignment means for guiding and aligning said jointed key within said keyhole.

20. A lock cylinder as defined in claim 4, wherein said at least one biased plunger is spring loaded.

21. A lock cylinder as defined in claim 4, wherein said at least one plunger is magnetically biased.

22. A lock cylinder as defined in claim 1, wherein said decoding means comprises at least one decoding pin slidably mounted within an elongated hole formed in said revolving cylinder for movement between locking and releasing positions; and biasing means for biasing said decoding pin for urging the same to said locking position wherein one free end of said decoding pin bridges the gap between said revolving cylinder and said external housing and is received within an opening generally coaxially aligned with said elongate hole, said decoding pin including a portion responsive to a force field, whereby insertion of a properly coded jointed key into said lock cylinder which produces the requisite force field proximate to said decoding pin portion causes the latter to move to said releasing position against the force of said biasing means.

23. A lock cylinder as defined in claim 22, wherein said force field is a magnetic field and wherein said decoding pin portion comprises a magnet.

24. A lock cylinder as defined in claim 22, wherein said force field is an electrostatic field, and wherein said decoding pin portion comprises an electret.

25. A lock cylinder as defined in claim 22, in combination with the jointed key, wherein said coded finger includes at least one force field producing material portion disposed on said coded finger to establish a force field proximate to said decoding pin portion in said final position of said coded finger.

26. A lock cylinder as defined in claim 25, wherein said force field producing portion comprises a magnet.

27. A lock cylinder as defined in claim 25, wherein said force field producing portion comprises an electret.

28. A lock cylinder as defined in claim 25, wherein at least one pair of coaxially aligned decoding pins are provided spaced from each other along their mutual axis and disposed on opposite sides of said cam surface, said force field producing material portion simultaneously actuating each of said pair of decoding pins in the final position of said coded finger.

29. A lock cylinder as defined in claim 22, wherein said mating surfaces of said external housing and of said revolving cylinder define a first junction plane, and wherein said decoding means further comprises at least one biased plunger consisting of two axially aligned portions which together define a second junction plane, said first and second junction planes normally being out of alignment and being placed into alignment only when said plunger abuts against and responds to an appropriately coded jointed key.

30. A lock cylinder as defined in claim 22, wherein said decoding means further comprises at least one pick-proof pin slidably mounted within a generally elongate hole formed in said revolving cylinder and including a portion responsive to a force field on a coded finger and locking portion movable between releasing and locking positions; and further biasing means for biasing said pick-proof pin for urging said locking portion to said releasing position thereof wherein said pick-proof pin is fully contained within said generally elongate hole in said revolving cylinder, said pick-proof pin including motion translation means cooperating with said force field responsive portion for urging said locking portion into said locking position upon any axial movement of said force field responsive portion.

* * * * *